US006565378B1

(12) United States Patent
Sawayanagi et al.

(10) Patent No.: US 6,565,378 B1
(45) Date of Patent: May 20, 2003

(54) ELECTRICAL CONNECTOR TERMINAL AND HOUSING

(75) Inventors: Masahiro Sawayanagi, Shizuoka-ken (JP); Toshiaki Okabe, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/716,382

(22) Filed: Nov. 21, 2000

(30) Foreign Application Priority Data

Nov. 22, 1999 (JP) ..... P11-331956

(51) Int. Cl.[7] ..... H01R 13/58
(52) U.S. Cl. ..... 439/456; 439/881
(58) Field of Search ..... 439/456, 881, 439/696, 345, 887

(56) References Cited

U.S. PATENT DOCUMENTS 4,097,109 A * 6/1978 Cross ..... 439/557
5,186,658 A * 2/1993 Kikuchi et al. ..... 439/595
5,915,992 A * 6/1999 Conorich et al. ..... 439/456

* cited by examiner

*Primary Examiner*—Lynn D. Feild
*Assistant Examiner*—Brian S. Webb
(74) *Attorney, Agent, or Firm*—Oblon, Spivak, McClelland, Maier & Neustadt, P.C.

(57) ABSTRACT

A connector comprises a connector terminal 33 including an electric wire connecting portion 52 to which an electric wire is connected, a terminal contact 53 to which a mating terminal is brought into contact, and a connecting portion 54 for connecting the electric wire connecting portion 52 and the terminal contact 53 with each other, in which one ends of the electric wire connecting portion 52 and the terminal contact 53 are connected to the connecting portion 54, and the other end of the electric wire connecting portion 52 and the terminal contact 53 are directed to the same direction; and a connector housing having a terminal accommodating chamber 34 for accommodating and holding the connector terminal 33, wherein the connector terminal 33 is inserted into the terminal accommodating chamber 34 from a direction in which the mating connector is inserted into the terminal accommodating chamber 34, the terminal falling-out preventing portion 51 is engaged with the connecting portion 54 for preventing the connector terminal 33 from falling out.

5 Claims, 11 Drawing Sheets

ELECTRICAL CONNECTOR TERMINAL AND HOUSING

BACKGROUND OF THE INVENTION

1. Field of the Invention

The present invention relates to a connector having a terminal accommodating chamber for accommodating and holding a terminal, and more particularly, to a connector for preventing a terminal from falling out from a terminal accommodating chamber and requiring no double-engaging member.

2. Description of the Related Art

FIGS. 1, 2 and 3 show a technique achieved by the present inventors.

As shown in FIG. 1, a substrate connector 101 includes a connector housing 102 including a plurality terminals 103 arranged therein. The terminals 103 are inserted through holes 105 formed in a printed wiring board 104. The terminals 103 and lands of the wiring pattern are soldered thereby mounting the terminals 103 to the printed wiring board 104.

As shown in FIG. 2, in the substrate connector 101, a mating connector 106 is inserted in a terminal accommodating chamber 107 of the connector housing 102. If the mating connector 106 is connected to the substrate connector 101, terminals (not shown) of the mating connector 106 comes into contact with the terminals 103 of the substrate connector 101.

However, as shown in FIG. 2, the terminals 103 provided on the connector housing 102 may be pushed out toward a back surface 104*b* of the printed wiring board 104 on the opposite side from a connector mounting surface 104*a* due to contact load of the terminals when or after the mating connector 106 is connected in many cases.

On the other hand, in the case of a so-called electric wire connector as shown in FIG. 3, electric wires 111 and 112 are connected to terminals 110 (one of them is not illustrated) accommodated in connector housings 108 and 109, respectively. The terminals 110 are connected to each other by connecting a female connector 113 to a male connector 114.

However, in the case of the electric wire connector, there is an adverse possibility that the connector terminal 110 is pulled out from the connector housing 109 by unintentional external force after the connectors were connected. To prevent this, as shown in FIG. 3, it is necessary to provide the connector housing 109 with a double engaging member 115 for prevent the terminal 110 from falling out. However, this increases the cost and the number of working steps.

As described above, in the case of the substrate connector 101 and electric wire connector 113, the terminal 103 or 110 may be pulled out, and the double engaging member 115 is required for preventing the terminal 110 from falling out and thus, the costs is increased and the number of working steps is increased.

SUMMARY OF THE INVENTION

Thereupon, the present invention has been proposed to solve the above problems, and it is an object of the invention to provide an inexpensive connector having a small number of working steps in which a terminal is prevented from falling out from a terminal chamber and no double engaging member is required.

To solve the above object, according to a first aspect, there is provided a connector comprising a connector terminal including an electric wire connecting portion to which an electric wire is connected, a terminal contact to which a mating terminal is brought into contact, and a connecting portion for connecting the electric wire connecting portion and the terminal contact with each other, in which one ends of the electric wire connecting portion and the terminal contact are connected to the connecting portion, and the other end of the electric wire connecting portion and the terminal contact are directed to the same direction; and a connector housing having a terminal accommodating chamber for accommodating and holding the connector terminal, wherein the connector terminal is inserted into the terminal accommodating chamber from a direction in which the mating connector is inserted into the terminal accommodating chamber.

According to the present invention, since the connector terminal is inserted into the terminal accommodating chamber from the direction in which the mating connector is inserted into the terminal accommodating chamber, the connector terminal does not fall out from the terminal accommodating chamber by the connection of the mating connector. Therefore, a double-engaging member for preventing the connector terminal from falling out from the terminal accommodating chamber is unnecessary.

Further, the electric wire connecting portion of the connector terminal and the terminal contact are not provided on the same line, but are disposed such that the base end is connected to the connecting portion and the other end is directed to the same direction. Therefore, the connector terminal can be made compact, and the connector itself can be reduced in size.

According to a second aspect of the invention, in the connector of the first aspect, the terminal accommodating chamber is formed with a terminal-insertion hole through which the connector terminal is inserted and held, and the terminal accommodating chamber is provided with a terminal falling-out preventing portion engaged with the connecting portion of the connector terminal inserted into the terminal-insertion hole.

With this aspect, since the terminal falling-out preventing portion formed in the terminal accommodating chamber is engaged with the connecting portion of the connector terminal inserted into the terminal-insertion hole, the connector terminal does not fall out from the terminal accommodating chamber.

According to a third aspect of the invention, in the connector of the first aspect, when the mating connector is inserted and connected into the terminal accommodating chamber, the connector terminal is pushed by the mating connector.

With this aspect, when the mating connector is inserted and connected into the terminal accommodating chamber, the connector terminal is pushed by the mating connector. Therefore, even if the connector terminal is in the incomplete fitted state, since the connector terminal is pushed deeply, the incomplete mounted state is avoided.

According to a fourth aspect of the invention, in the connector of the first aspect, the electric wire connecting portion and the terminal contact of the connector terminal are integrally formed together with the connecting portion.

In the present invention, since the electric wire connecting portion and the terminal contact are integrally formed together with the connecting portion, the effect of the invention of the first to third aspect can be achieved more reliably.

BRIEF DESCRIPTION OF THE DRAWINGS

FIG. 7 show a visor-side bracket, wherein

FIG. 8 show a female connector, wherein

FIG. 10 show a panel-side bracket, wherein

FIG. 11 show a female terminal accommodated in a male connector, wherein FIG. 12 show a cover, wherein

DESCRIPTION OF THE PREFERRED EMBODIMENT

A concrete embodiment to which the present invention is applied will be explained in detail with reference to the drawings below.

In the present embodiment, the present invention is applied to a connector mounted to a vehicle-body bracket for fixing a sun visor (auxiliary equipment) provided on an upper end of a front window of a driver's seat or a passenger's seat of an automobile for example to a vehicle body (panel).

"Structure of a Vehicle-body Mounting Bracket"

Figure 4:
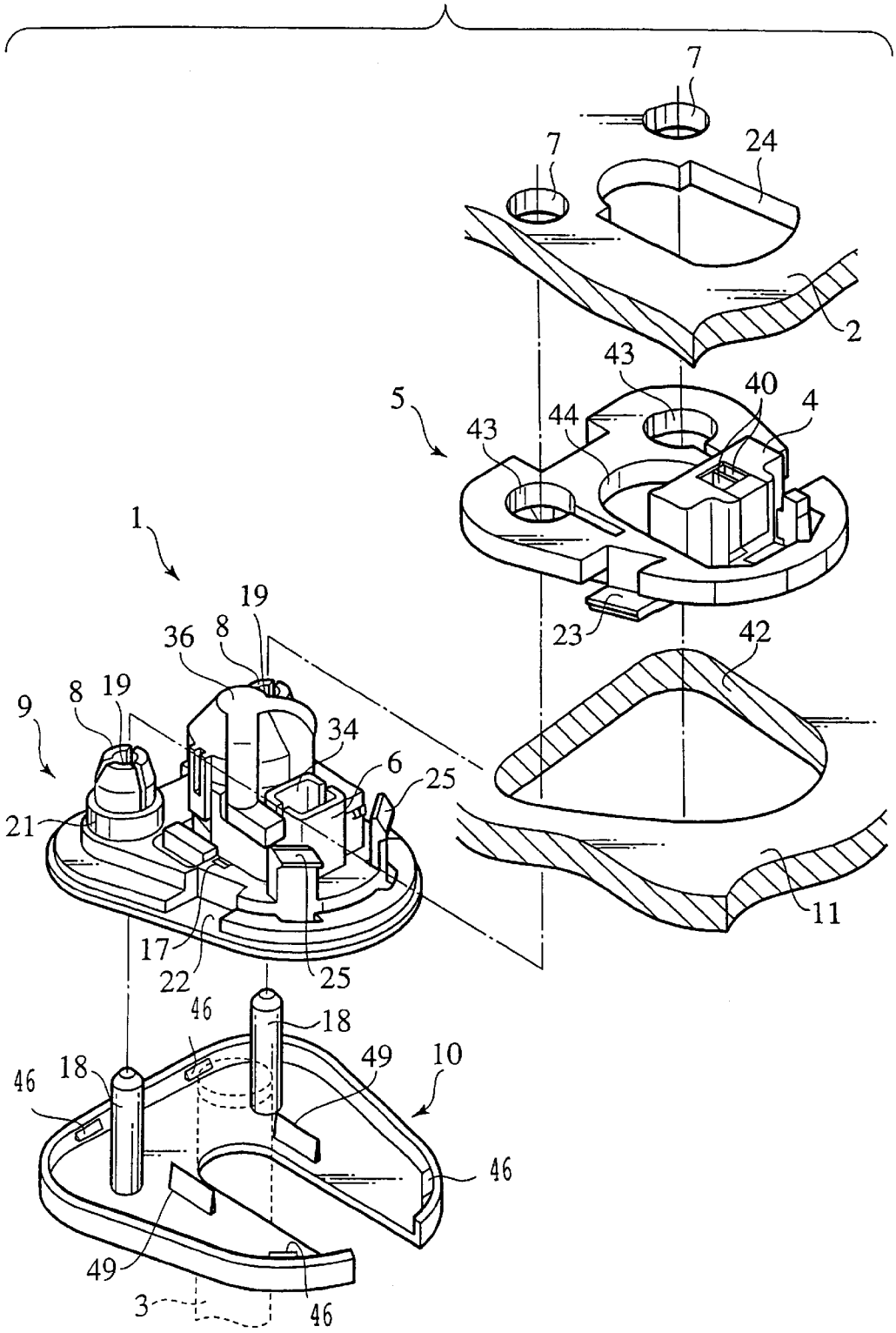
FIG. 4 is an exploded perspective view of a vehicle-body mounting bracket that is an auxiliary equipment in this embodiment.

A vehicle-body mounting bracket 1 as auxiliary equipment in the present embodiment is for fixing a sun visor (not shown) to an inner panel 2 of a vehicle body as shown in FIG. 4. The vehicle-body mounting bracket 1 is mounted to a tip end of a fixed shaft 3 that supports the sun visor. The vehicle-body mounting bracket 1 includes a panel-side bracket 5 that is a first bracket having a male connector 4 that is a first connector, and a female connector 6 that is a second connector that coalesces with the panel-side bracket 5 and connected with the male connector 4. The vehicle-body mounting bracket 1 also includes a visor-side bracket 9 that is a second bracket having cylindrical grommet screws 8 and 8 inserted to bracket-mounting holes 7 and 7 formed in the inner panel 2 and engaged with the inner panel 2. The vehicle-body mounting bracket 1 also includes a cover 10 mounted to the visor-side bracket 9 on the opposite side from the side to which the panel-side bracket 5 is coalesced.

"Structure of the Visor-side Bracket"

Figure 5:
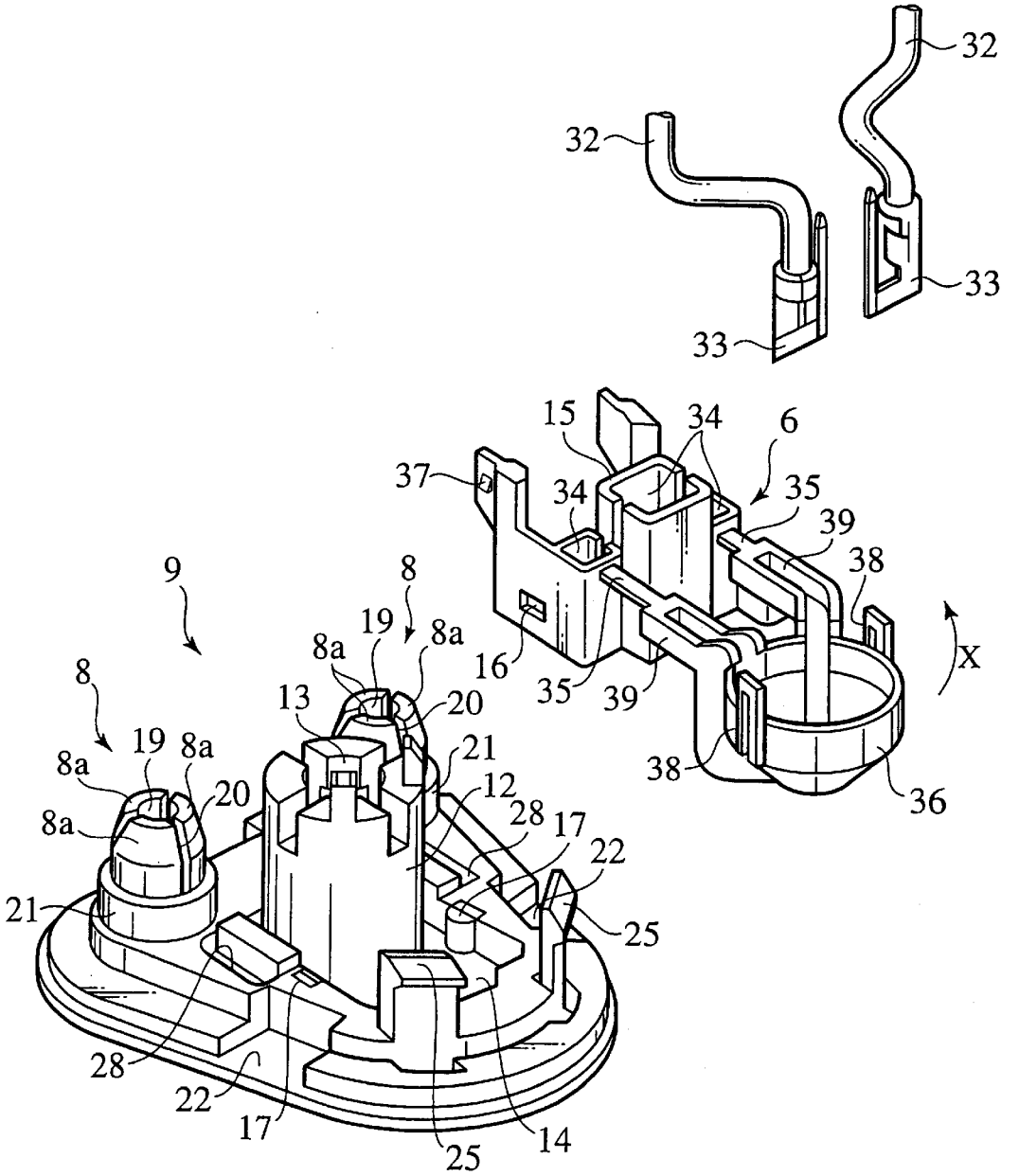
FIG. 5 is an exploded perspective view of a visor-side bracket and a female connector mounted thereto.
Figure 7B:
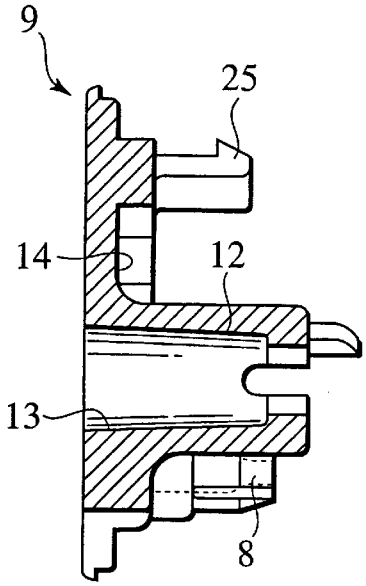
FIG. 7B is a sectional view taken along a line 7B—7B in FIG. 7A.
Figure 7A:
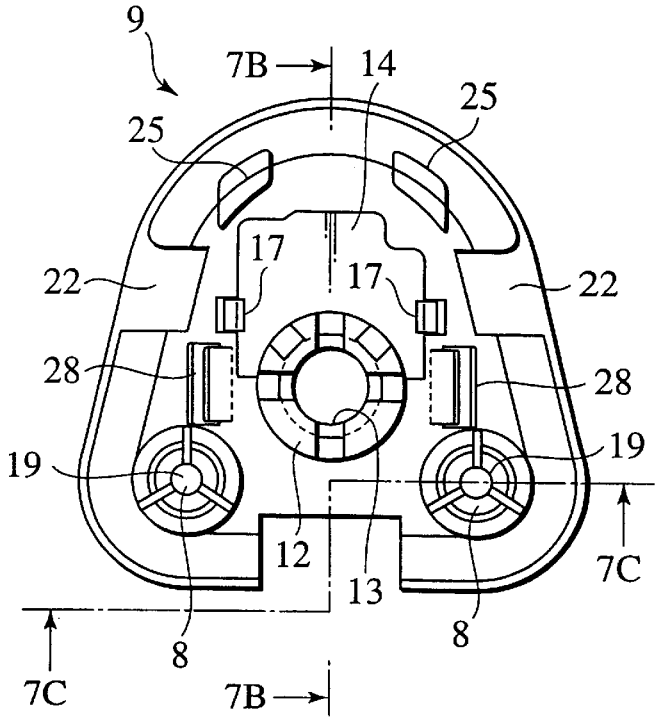
FIG. 7A is a plan view.
Figure 7C:
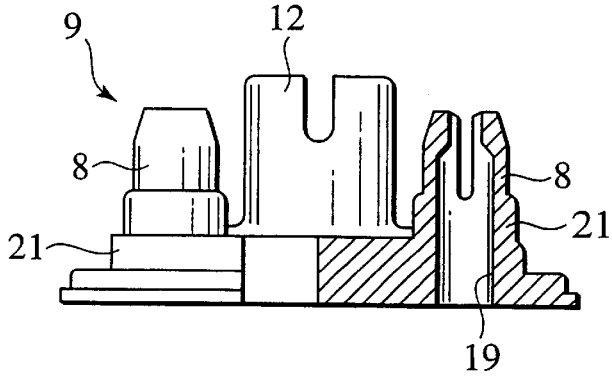
FIG. 7C is a sectional view taken along a line 7C—7C in FIG. 7A.

As shown in FIG. 4, the visor-side bracket 9 is fixed to the inner panel 2 that is provided on the opposite side from the panel-side bracket 5 with respect to a trim 11 that is an interior member fixed to the inner panel 2. As shown in FIGS. 5 and 7, the visor-side bracket 9 is formed with a shaft-fixing portion 12 for holding a tip end of the fixed shaft 3. The shaft-fixing portion 12 is formed into a cylindrical body provided at its center with a shaft-fixing hole 13 through which the fixed shaft 3 is inserted.

As shown in FIGS. 5 and 7, the visor-side bracket 9 is formed with a connector-mounting portion 14 for mounting the female connector 6. The connector-mounting portion 14 is formed as a recess for mounting the female connector 6 in front of the shaft-fixing portion 12, and the female connector 6 is fitted and mounted into the connector-mounting portion 14 in a rattle-free manner. The connector-mounting portion 14 is formed with connector-fixing lock claws 17 and 17 fitted into lock engaging holes 16 and 16 formed in a female connector housing 15 of the female connector 6 for fixing the female connector 6 to the visor-side bracket 9.

As shown in FIGS. 4 and 7, the visor-side bracket 9 is formed with grommet screws 8 and 8 formed in the inner panel 2 that are inserted in the bracket-mounting holes 7 and 7 formed in the inner panel 2. The grommet screws 8 and 8 are formed as cylindrical bodies having center holes 19 through which grommet-screw projections 18 and 18 formed on the cover 10 which will be described later. Each of the grommet screws 8 and 8 is formed with slits 20 from its tip end to its base portion in the height direction, thereby dividing the screw substantially uniformly into three portions as movable screw pieces 8*a*, 8*a* and 8*a*.

The grommet screws 8 and 8 are formed at their base ends with bracket supports 21 and 21 for supporting the panel-side bracket 5. The bracket supports 21 and 21 are formed as cylindrical bodies having greater diameter than the grommet screws 8 and 8 and are integrally formed on the base ends of the grommet screws 8 and 8. The bracket supports 21 and 21 has annular upper end surfaces on which the panel-side bracket 5 is placed for supporting the latter.

As shown in FIGS. 5 and 7, the visor-side bracket 9 is formed with coalescing recesses 22 and 22 for coalescing the panel-side bracket 5. The coalescing recesses 22 and 22 are formed on opposite sides of the connector-mounting portion 14. Mounting claws 23 and 23 formed on the panel-side bracket 5 are fitted to the coalescing recesses 22 and 22 to position the panel-side bracket 5 to the visor-side bracket 9.

As shown in FIG. 5 and 7, the visor-side bracket 9 is formed with hanging claws 25 and 25 facing space (not shown) between the inner panel 2 and an outer panel and engaged with inner surface of the inner panel 2 by a connector-insertion hole 24 formed in the inner panel 2.

Figure 6:
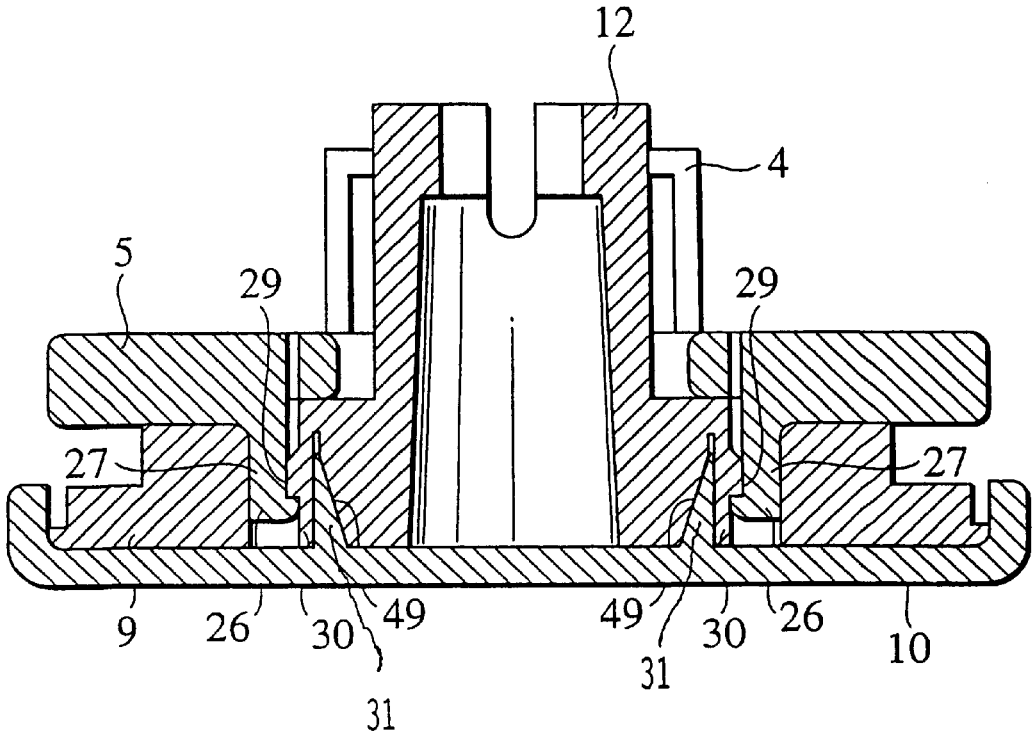
FIG. 6 is a sectional view of the assembled vehicle-body mounting bracket.

As shown in FIG. 6, the visor-side bracket 9 is formed with holes 28 and 28 through which locking pieces 27 and 27 provided on tip ends of locking claws 26 and 26 formed on the panel-side bracket 5 (which will be described later) are inserted. The holes 28 and 28 are provided with lock arms 30 and 30 having engaging projections 29 and 29 engaging the locking claws 26 and 26. Portions of the lock arms 30 and 30 on which the panel-side bracket 5 is coalesced are formed into tongue-like shape hanging down toward back surface on which the cover 10 is mounted, and free ends of the lock arms 30 and 30 facing the holes 28 and 28 such that bent space 31 is generated between the visor-side bracket 9 and the lock arms 30 and 30.

"Structure of Female Connector"

As shown in FIGS. 4 and 5, the female connector 6 mounted to the visor-side bracket 9 includes a female connector housing 15 fitted and mounted to the connector-mounting portion 14. The female connector housing 15 is formed with a terminal accommodating chamber 34 for accommodating connector terminals 33 and 33 provided on tip ends of lead wires 32 and 32 connected to a lamp provided on the sun visor.

Figure 8C:
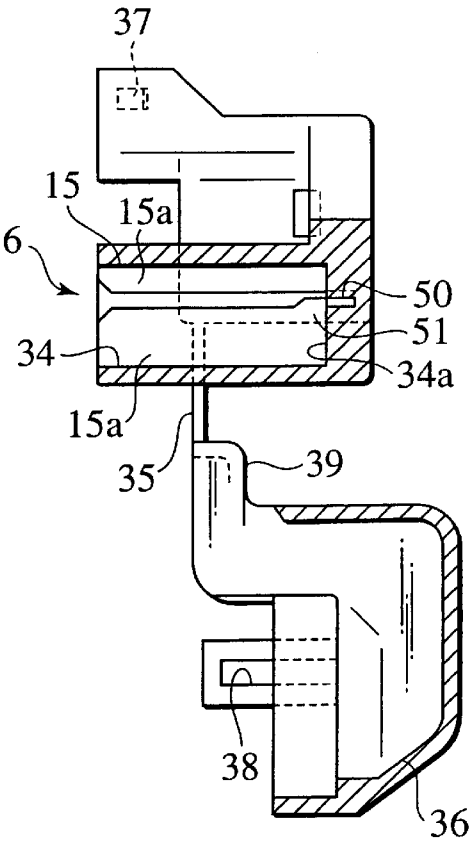
FIG. 8C is a sectional view.
Figure 8A:
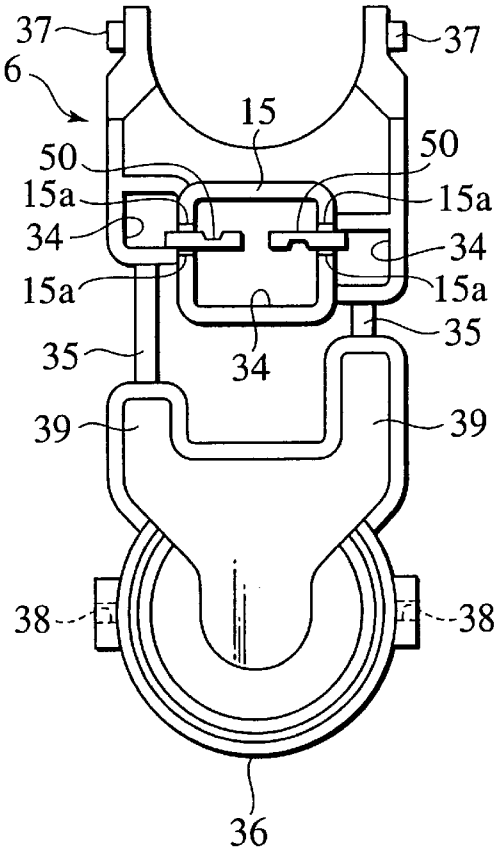
FIG. 8A is a plan view.
Figure 8B:
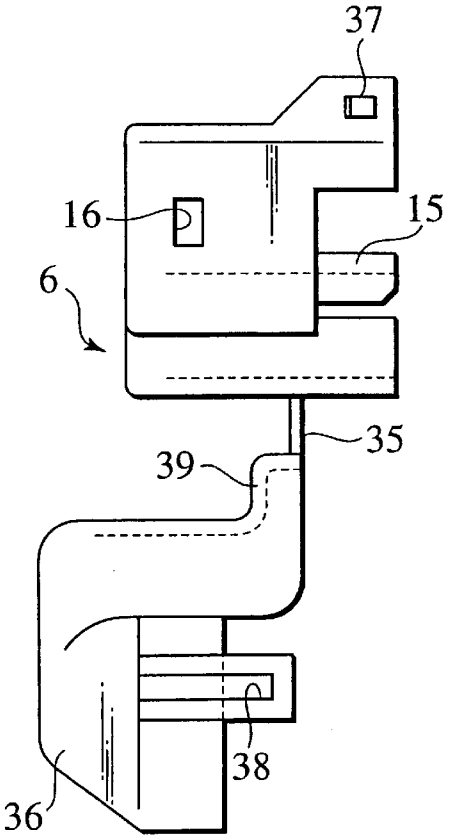
FIG. 8B is a side view.
Figure 9:
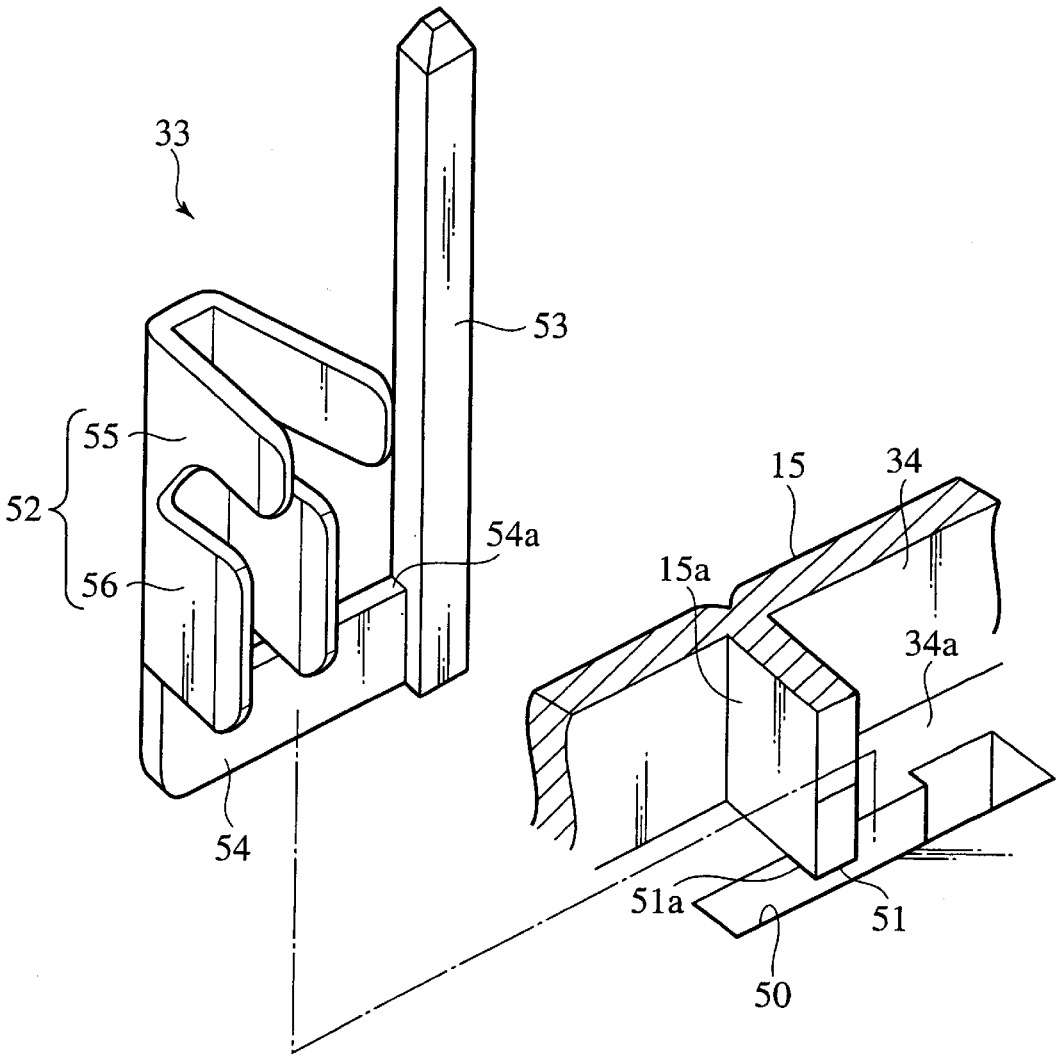
FIG. 9 is a perspective view of an essential portion of a connector terminal and a terminal accommodating chamber in which the connector terminal is accommodated.

As shown in FIGS. 8 and 9, a bottom surface 34*a* of the terminal accommodating chamber 34 is formed with terminal-insertion holes 50 and 50 in which the connector terminals 33 and 33 are inserted and held. The terminal-insertion holes 50 and 50 are formed as stopping holes having rectangular bottoms in which connecting portions 54 of the connector terminals 33 and 33 are inserted. The terminal-insertion holes 50 and 50 guide the connector terminals 33 and 33 in a rattle-free manner. In a state where the connector terminals 33 and 33 are inserted and held in the terminal-insertion holes 50 and 50, upper edges 54*a* of the connecting portions 54 project slightly or do not project from the terminal-insertion holes 50 and 50.

The terminal accommodating chamber 34 is formed with a terminal falling-out preventing portion 51 engaged with connecting portions 54 of the connector terminals 33 and 33 inserted into the terminal-insertion holes 50 and 50. The terminal falling-out preventing portion 51 is provided on a base end of one housing partition wall 15*a* for grasping the connector terminals 33 and 33 from the thickness direction for guiding. The terminal falling-out preventing portion 51 is provided such as to slightly project upward from the terminal-insertion holes 50 and 50. A lower end surface 51*a* of the terminal falling-out preventing portion 51 comes into contact with the upper edges 54*a* of the connecting portions 54 inserted into the terminal-insertion holes 50 and 50 so that the connector terminals 33 and 33 are prevented from falling out from the terminal accommodating chamber 34.

The female connector housing 15 is formed with a lock engaging holes 16 and 16 into which the connector-fixing lock claws 17 and 17 formed on the visor-side bracket 9 are inserted and engaged. The female connector housing 15 is provided with an electric wire protecting member 36 that is movable in a direction of an arrow X in FIG. 5 through hinge portions 35 and 35. The electric wire protecting member 36 is formed as a cap for covering and protecting the electric wires 32 and 32 led out from tip end of the shaft-fixing portion 12 through the fixed shaft 3. The electric wire protecting member 36 is mounted to a tip end of the shaft-fixing portion 12.

Arms 39 and 39 connected to the hinge portions 35 and 35 of the electric wire protecting member 36 cover and protect respective electric wires 32 and 32 led out into the terminal accommodating chamber 34 from the tip end of the fixed shaft 3. The electric wire protecting member 36 is formed with an engaging hole 38 through which a cap-holding projection 37 provided on the female connector housing 15 is inserted and engaged for fixing and holding the electric wire protecting member 36 to the female connector housing 15 using the hinge portions 35 as a bent portion.

"Structure of Connector Terminal"

As shown in FIGS. 5 and 9, each of the connector terminals 33 and 33 comprises an electric wire connecting portion 52 to which the electric wires 32 is connected, a terminal contact 53 with which the mating terminal comes into contact, and a connecting portion 54 for connecting the electric wire connecting portion 52 and the terminal contact 53. The connector terminals 33 and 33 are integrally formed by punching and bending a metal plate.

The electric wire connecting portion 52 comprises an electric wire swaging portion 55 for swaging an insulation-coated portion of the electric wires 32, and a core wire swaging portion 56 for swaging a core wire of the electric wires 32. FIG. 9 shows a state before the electric wire swaging portion 55 and the core wire swaging portion 56 are swaged. The electric wire connecting portion 52 connects a base end of the core wire swaging portion 56 that is one end of the electric wire connecting portion 52 to the connecting portion 54 and turns the electric wire swaging portion 55 that is the other end upward.

The terminal contact 53 is formed as a bar-like contact that is brought into contact with a mating female terminal. A base end of the terminal contact 53 that is one end thereof is connected to the connecting portion 54 and a tip end that is the other end thereof is turned upward that is the same direction as the electric wire connecting portion 52.

The connecting portion 54 is formed as a flat plate-like body, and is inserted into the terminal-insertion holes 50 and 50 in an insertion direction that is a direction of short side of the connecting portion 54. The connecting portion 54 is provided at its longitudinally opposite ends with the electric wire connecting portion 52 and the terminal contact 53 substantially in parallel to each other in the upward direction that is the same direction. As a result, the connector terminals 33 and 33 are formed into U-shape as viewed from above.

"Structure of Panel-side Bracket"

Figure 10A:
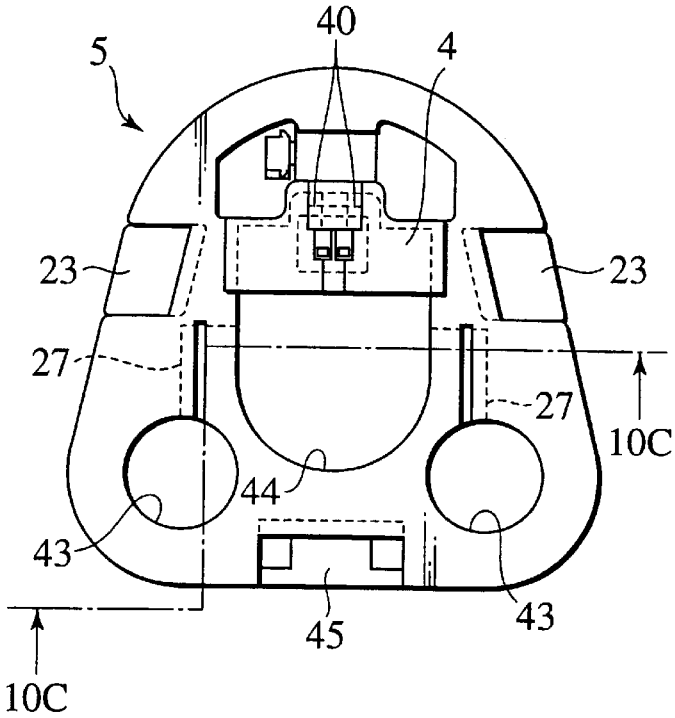
FIG. 10A is a plan view.
Figure 10B:
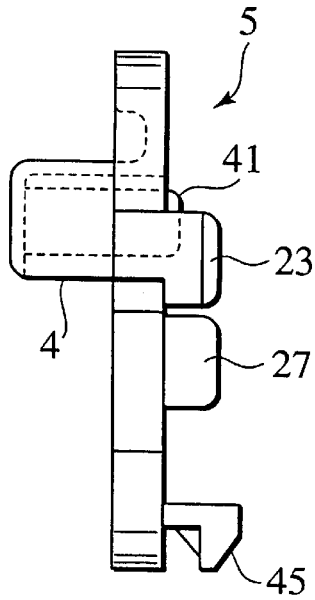
FIG. 10B is a right side view.
Figure 10C:
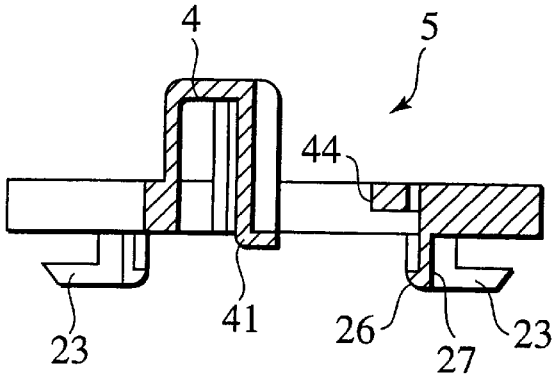
FIG. 10C is a sectional view taken along a line 10C—10C.

As shown in FIGS. 4 and 10, the panel-side bracket 5 coalesces with the visor-side bracket 9 with the trim 11 interposed therebetween to connect the male connector 4 and the female connector 6 with each other. The panel-side bracket 5 is provided with the male connector 4 that is connected to the female connector 6 fixed to the visor-side bracket 9. The male connector 4 is formed with a male connector housing 41 having a terminal accommodating chamber 40 for accommodating a female terminal 57 (which will be described later) connected to a tip end of a wire harness disposed in space between the inner panel 2 and the outer panel. The male connector housing 41 is inserted and fitted in the female connector housing 15 of the female connector 6 for bringing respective terminals into electrical contact.

The panel-side bracket 5 includes mounting claws 23 and 23 fitted into coalescing recesses 22 and 22 formed in the visor-side bracket 9 for coalescing with the visor-side bracket 9. As shown in FIGS. 4 and 10, the mounting claws 23 and 23 are formed into substantially L-shape such that the mounting claws 23 and 23 face the visor-side bracket 9 from an opening 42 formed in the trim 11.

The panel-side bracket 5 is formed with circular holes 43 and 43 in which the grommet screws 8 and 8 are loosely fitted through the opening 42, a release hole 44 for preventing the electric wire protecting member 36 from coming into contact with the panel-side bracket 5, and a trim-engaging claw 45 engaging the trim 11.

As shown in FIGS. 6 and 10, the panel-side bracket 5 is formed with the locking pieces 27 and 27 provided at their tip ends with the locking claws 26 and 26. The locking pieces 27 and 27 are formed as rectangular tongue pieces handing down toward the visor-side bracket 9, and inserted into the holes 28 and 28 formed in the visor-side bracket 9. The locking claws 26 and 26 formed on the tip ends of the locking pieces 27 and 27 engage the engaging projections 29 and 29 of the lock arms 30 and 30 formed on the visor-side bracket 9.

Figure 11B:
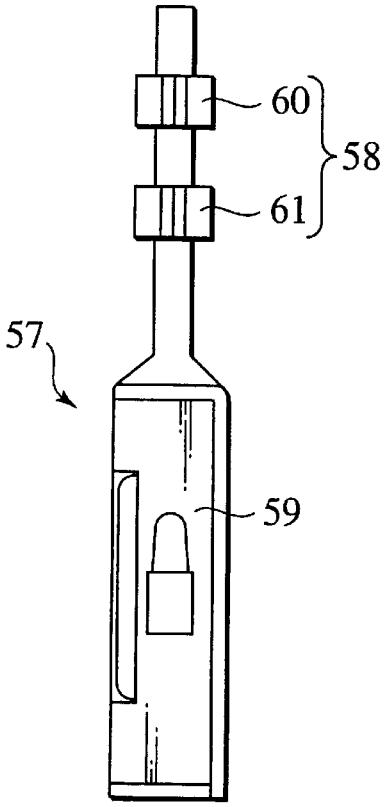
FIG. 11B is a side view.
Figure 11A:
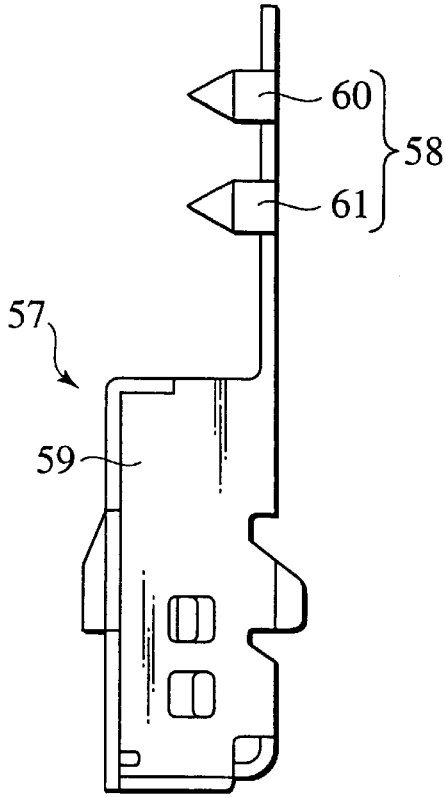
FIG. 11A is a plan view.
Figure 11C:
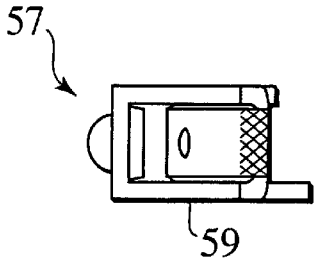
FIG. 11C is a bottom view.

As shown in FIG. 11, the female terminal 57 accommodated in the male connector housing 41 comprises an electric wire connecting portion 58 and a terminal contact 59. The electric wire connecting portion 58 comprises an electric swaging portion 60 for swaging an insulation-coated portion of a wire harness disposed in space between the inner panel 2 and the outer panel, and a core wire swaging connecting portion 61 for swaging the core wire. The terminal contact 59 is formed into a box-like shape into which the terminal contact 53 of the connector terminals 33 and 33 is inserted for establishing electrical contact.

"Structure of Cover"

Figure 12B:
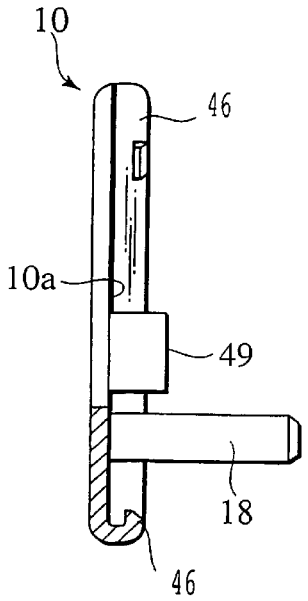
FIG. 12B is a sectional view taken along a line 12B—12B.
Figure 12A:
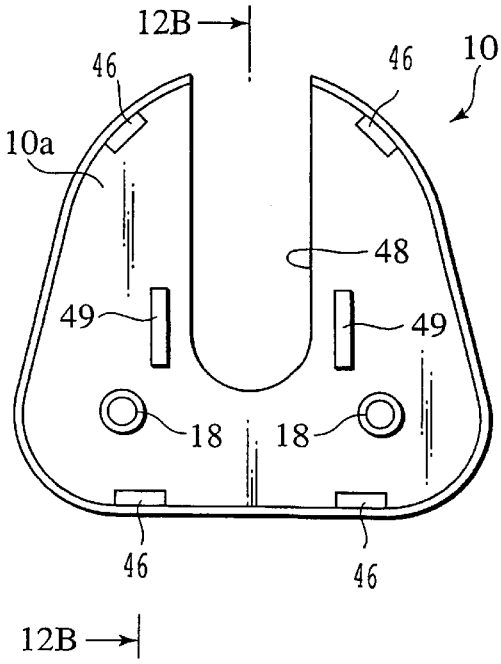
FIG. 12A is a plane view.
Figure 12C:
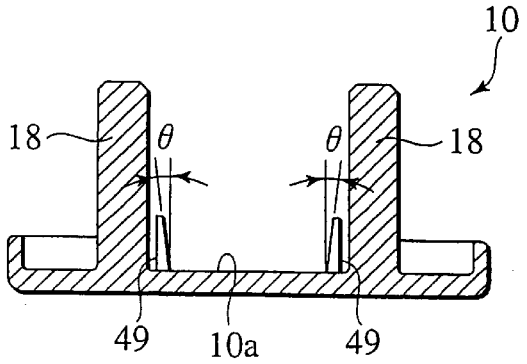
FIG. 12C is a transverse sectional view.

As shown in FIG. 4, the cover 10 is mounted on the visor-side bracket 9 on the opposite side from the panel-side bracket 5 to be coalesced. The cover 10 covers the visor-side bracket 9. As shown in FIGS. 4 and 12, the cover 10 is provided with a plurality of assembling claws 46 that are engaging claws engaged with outer peripheral edges of the visor-side bracket 9 for fixing the cover 10 to the visor-side bracket 9.

The cover 10 is formed with a notch 48 through which the fixed shaft 3 is inserted. The notch 48 is formed as a notched groove formed straightly from a portion of the outer side edge of the cover 10 to a substantially central portion thereof. Further, the cover 10 is formed with locking projections 49 and 49 inserted into bent space 31 formed in the visor-side bracket 9 for pushing the lock arms 30 and 30 against the locking pieces 27 and 27 formed n the panel-side bracket 5.

As shown in FIGS. 6 and 12, the locking projections 49 and 49 are formed as rectangular tongue pieces. The locking projections 49 and 49 are inclined through angle of θ with respect to a perpendicular such that a distance therebetween is increased toward their tip end. That is, the locking projections 49 and 49 are inclined with respect to an inner surface 10*a* of the cover 10, and not perpendicular to the inner surface 10*a*. If the locking projections 49 and 49 formed in this manner are fitted into the bent space 31, the lock arms 30 and 30 are pushed by the locking projections 49 and 49 and pushed toward the locking pieces 27 and 27.

"Mounting Method of Sun Visor"

The sun visor using the vehicle-body mounting bracket 1 structured as described above is mounted to the vehicle body in the following manner.

First, as shown in FIG. 4, the panel-side bracket 5 is mounted to the trim 11. That is, the mounting claws 23 and 23, the male connector housing 41, the locking pieces 27 and 27 and the trim-engaging claw 45 are turned toward the opening 42. The trim-engaging claw 45 is hooked on the trim 11, and the panel-side bracket 5 is mounted such as to cover the opening 42. Then, the trim 11 to which the panel-side bracket 5 is mounted is fixed to the inner panel 2.

Next, the visor-side bracket 9 fixed to the tip end of the fixed shaft 3 is coalesced with the panel-side bracket 5 with the trim 11 interposed therebetween. That is, the grommet screws 8 and 8, the electric wire protecting member 36, the female connector 6 and the hanging claws 25 and 25 are turned toward the opening 42 formed in the trim 11. The mounting claws 23 and 23 are aligned with the coalescing recesses 22 and 22 of the visor-side bracket 9, and the visor-side bracket 9 is coalesced with the panel-side bracket 5.

The grommet screws 8 and 8 face the circular holes 43 and 43 formed in the panel-side bracket 5 and the bracket-mounting holes 7 and 7 formed in the inner panel 2, and the tip end thereof projects into the space between the inner panel 2 and the outer panel. The electric wire protecting member 36 faces the release hole 44 formed in the panel-side bracket 5.

Figure 1:
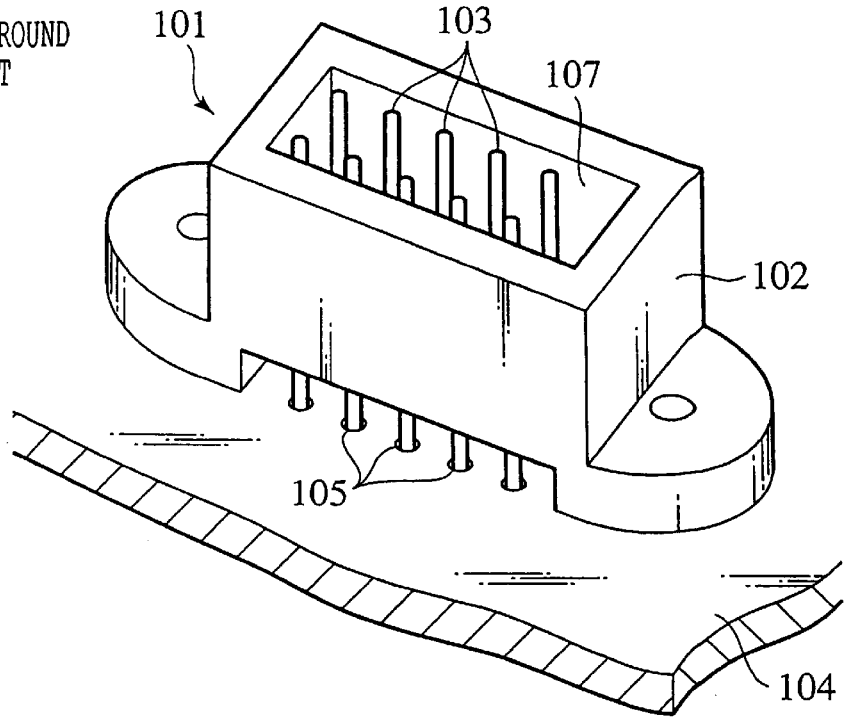
FIG.1 BACKGROUND ART
FIG. 1 is a perspective view showing a conventional substrate connector mounted to a printed wiring board.
Figure 2:
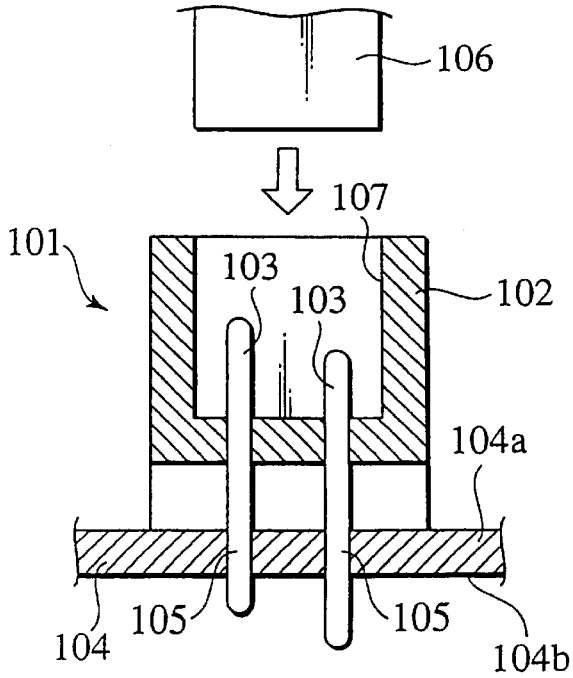
FIG.2 BACKGROUND ART
FIG. 2 is a sectional view showing a terminal pulled out from connector housing when a mating connector is mounted to the substrate connector.
Figure 3:
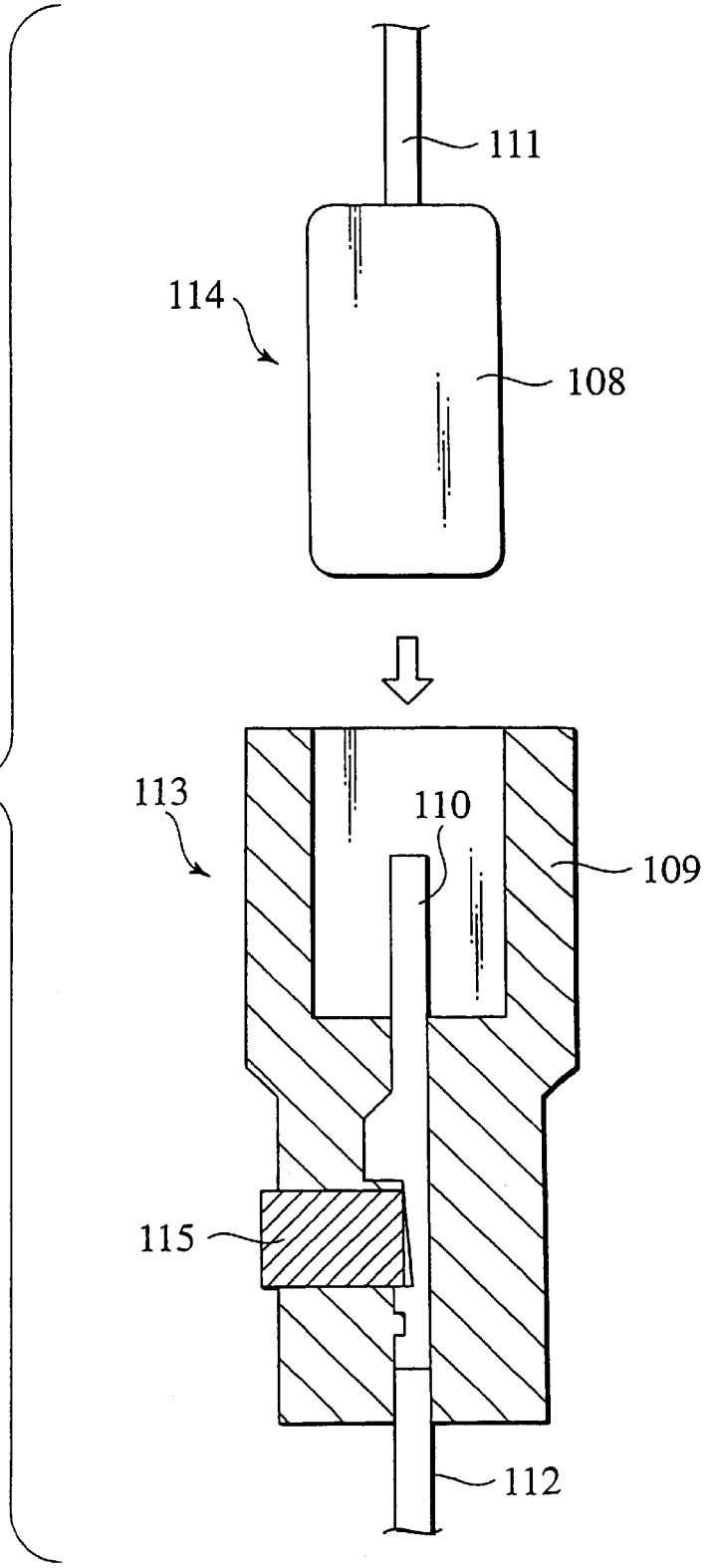
FIG.3 BACKGROUND ART
FIG. 3 is a sectional view an electric wire connector provided with a double engaging member to which a mating connector is connected.

When the visor-side bracket 9 is coalesced with the panel-side bracket 5, the locking pieces 27 and 27 formed on the panel-side bracket 5 are inserted into the holes 28 and 28 formed in the visor-side bracket 9, and the male connector housing 41 of the male connector 4 is fitted into the female connector housing 15 of the female connector 6. Then, as shown in FIG. 3, when the visor-side bracket 9 and the panel-side bracket 5 are coalesced, the male connector housing 41 and the female connector housing 15 are connected to each other, and the locking claws 26 and 26 of the locking pieces 27 and 27 and the engaging projections 29 and 29 of the lock arms 30 and 30 are engaged with each other. When the locking claws 26 and 26 and the engaging projections 29 and 29 are engaged with each other, the coalesced state between the panel-side bracket 5 and the visor-side bracket 9 is locked.

As shown in FIG. 3, the engaged state between the locking claws 26 and 26 and the engaging projections 29 and 29 can visually checked from the holes 28 and 28 formed in the visor-side bracket 9. Therefore, it is possible to visually check whether the panel-side bracket 5 and the visor-side bracket 9 are completely coalesced or whether the male connector housing 41 and the female connector housing 15 are connected to each other, and it is possible to detect a halfway-fitted state of the connector before the mounting operation of the sun visor is completed.

If the locking claws 26 and 26 and the engaging projections 29 and 29 are normally engaged with each other as shown in FIG. 3, the male connector housing 41 and the female connector housing 15 are reliably connected to each other, and the bent space 31 secures desired space. If such a state is not obtained, the engaging projections 29 and 29 are pushed by the locking claws 26 and 26 and the lock arms 30 and 30 are bent, the bent space is reduced or eliminated, and the male connector housing 41 and the female connector housing 15 are brought into the incomplete connected halfway-fitted state.

When the male connector housing 41 and the female connector housing 15 are connected to each other, the connector terminals 33 and 33 accommodated in the female connector housing 15 and the female terminal 57 accommodated in the male connector housing 41 are brought into contact with each other. At that time, even if the connector terminals 33 and 33 are in the incomplete fitted state, since the connector terminals 33 and 33 are pushed deeply by the male connector housing 41, the incomplete mounted state is avoided.

Next, as shown in FIG. 6, the cover 10 is mounted to the visor-side bracket 9. That is, as shown in FIG. 6, the grommet-screw projections 18 and 18 formed on the cover 10 are inserted into the center holes 19 of the grommet screws 8 and 8. Then, the tip ends of the grommet screws 8 and 8 are pushed and opened by the grommet-screw projections 18 and 18. With this, the tip ends of the screw pieces 8*a*, 8*a* and 8*a* are opened, the screw pieces 8*a*, 8*a* and 8*a* are pressed by the opening peripheral edges of the bracket-mounting holes 7 and 7. As a result, the vehicle-body mounting bracket 1 is fixed to the inner panel 2.

The locking projections 49 and 49 are brought into the bent space 31 of the visor-side bracket 9. Then, as shown in FIG. 6, the lock arms 30 and 30 are biased toward the locking pieces 27 and 27 formed on the panel-side bracket 5 by the locking projections 49 and 49, and the engaging state between the locking claws 26 and 26 and the engaging projections 29 and 29 is further enhanced.

According to the present embodiment, the connector terminals 33 and 33 are inserted into the terminal accommodating chamber 34 in the connecting direction in which the male connector 4 is inserted into the terminal accommodating chamber 34. Therefore, the connector terminals 33 and 33 do not fall out from the terminal accommodating chamber 34 by the connection between the male connector 4 and the connector terminals 33 and 33. Thus, a double-engaging member for preventing the connector terminals 33 and 33 from falling out from the terminal accommodating chamber 34 is unnecessary.

Further, according to the present embodiment, the terminal falling-out preventing portion 51 formed on the terminal accommodating chamber 34 is engaged with the connecting portion 54 of the connector terminals 33 and 33 inserted into the terminal-insertion holes 50 and 50, the connector terminals 33 and 33 do not fall out from the terminal accommodating chamber 34.

Although the concrete one embodiment to which the present invention is applied has been explained, the invention is not limited to this embodiment, and various modifications can be made.

Although the present invention is applied to the connector provided on the bracket for fixing the sun visor to the panel in the present embodiment, the connector of the invention can be applied to connectors used in various field. The above-described connector terminal is of U-shape as viewed from above, the shape is not limited to the U-shape.

What is claimed is:

1. A connector comprising:

a connector terminal including an electric wire connecting portion to which an electric wire is connected, a terminal contact to which a mating terminal is brought into contact, and an intermediate connecting portion for connecting said electric wire connecting portion and said terminal contact with each other, in which a first end of said electric wire connecting portion and a first end of said terminal contact are connected to said intermediate connecting portion, and a second end of said electric wire connecting portion and a second end of said terminal contact are directed to the same direction as each other in relation to said intermediate connecting portion;

a connector housing having a terminal accommodating chamber for accommodating and holding said connector terminal, said terminal accommodating chamber including a bottom surface with terminal insertion holes into which the connector terminals are inserted; and a housing partition wall provided on said connector housing for guiding said connector terminal into said terminal insertion holes of said terminal accommodating chamber, wherein said connector terminal is inserted into said terminal accommodating chamber from a direction in which said mating connector is inserted into said terminal accommodating chamber.

2. A connector according to claim 1, wherein said terminal accommodating chamber is formed with a terminal-insertion hole through which said connector terminal is inserted and held, said terminal accommodating chamber is provided with a terminal falling-out preventing portion engaged with said intermediate connecting portion of said connector terminal inserted into said terminal-insertion hole, and said terminal falling-out preventing portion is provided on a base end of said housing partition wall so as to slightly project upward from said terminal-insertion hole.

3. A connector according to claim 1, wherein when said mating connector is inserted and connected into said terminal accommodating chamber, said connector terminal is pushed by said mating connector.

4. A connector according to claim 1, wherein said electric wire connecting portion and said terminal contact of said connector terminal are integrally formed together with said intermediate connecting portion.

5. A connector according to claim 1, wherein said electric wire connecting portion includes an electric wire swaging portion for swaging an insulation-coated portion of said electric wire, and a core wire swaging portion for swaging a core wire of said electric wire, a portion of a base end of said core wire swaging portion that is one end is connected to said intermediate connecting portion, and said electric wire swaging portion that is the other end is turned toward the same direction as said electric wire connecting portion.

* * * * *

UNITED STATES PATENT AND TRADEMARK OFFICE

CERTIFICATE OF CORRECTION

PATENT NO. : 6,565,378 B1 
DATED : May 20, 2003
INVENTOR(S) : Masahiro Sawayanagi et al.

It is certified that error appears in the above-identified patent and that said Letters Patent is hereby corrected as shown below:

Title page,
Item [57], ABSTRACT,
Line 6, change "ends" to -- end --

Column 9,
Line 21, change "field" to -- fields --

Signed and Sealed this

Second Day of December, 2003

JAMES E. ROGAN
*Director of the United States Patent and Trademark Office*